US008727347B2

(12) United States Patent
Ishikawa

(10) Patent No.: US 8,727,347 B2
(45) Date of Patent: May 20, 2014

(54) SHEET FEEDING APPARATUS

(75) Inventor: Hiroko Ishikawa, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 145 days.

(21) Appl. No.: 13/415,331

(22) Filed: Mar. 8, 2012

(65) Prior Publication Data

US 2012/0307282 A1 Dec. 6, 2012

(30) Foreign Application Priority Data

May 31, 2011 (JP) ..... 2011-122242

(51) Int. Cl.
*B65H 7/02* (2006.01)

(52) U.S. Cl.
USPC ..... 271/265.04; 271/262; 271/263

(58) Field of Classification Search
USPC ..... 271/262, 263, 265.04
See application file for complete search history.

(56) References Cited

U.S. PATENT DOCUMENTS

| | | | | |
|---|---|---|---|---|
| 7,445,209 | B2 * | 11/2008 | Sano et al. | 271/263 |
| 8,419,014 | B2 * | 4/2013 | Yamagishi et al. | 271/262 |
| 2005/0184453 | A1 * | 8/2005 | Sano et al. | 271/262 |

FOREIGN PATENT DOCUMENTS

| | | | |
|---|---|---|---|
| JP | 2000-095390 | A | 4/2000 |
| JP | 2010-124423 | A | 6/2010 |

* cited by examiner

*Primary Examiner* — Michael McCullough
*Assistant Examiner* — Howard Sanders
(74) *Attorney, Agent, or Firm* — Scully, Scott, Murphy & Presser, PC

(57) ABSTRACT

A sheet feeding apparatus, including: a sheet feeding mechanism; a sheet sensor for detecting, as a detection value, a physical quantity related to a fed sheet; a physical-quantity judgment section for judging whether the detection value falls within a predetermined range; an another-sheet judgment section for judging whether there is another sheet after a sheet to be judged by the physical-quantity judgment section; and a double-feeding judgment section for judging that double feeding has occurred when the physical-quantity judgment section judges that the detection value does not fall within the predetermined range and when the another-sheet judgment section judges that there is another sheet, and judging that the double feeding has not occurred when the physical-quantity judgment section judges that the detection value does not fall within the predetermined range and when the another-sheet judgment section judges that there is no another sheet.

17 Claims, 8 Drawing Sheets

SHEET FEEDING APPARATUS

CROSS REFERENCE TO RELATED APPLICATION

The present application claims priority from Japanese Patent Application No. 2011-122242, which was filed on May 31, 2011, the disclosure of which is herein incorporated by reference in its entirety.

BACKGROUND OF THE INVENTION

1. Field of the Invention

The present invention relates to a technique for judging an occurrence of double feeding in which a plurality of sheets are fed together with the sheets overlapping one another.

2. Description of the Related Art

A sheet feeding apparatus such as a recording apparatus, an image reading apparatus, and a facsimile machine includes a feeding mechanism for feeding a sheet such as a document and a recording sheet. This sheet feeding apparatus including the feeding mechanism needs to prevent what is called double feeding (overlapping feeding) in which a plurality of sheets are fed together with the sheets partly or completely overlapping one another. As one example for preventing the double feeding, there is conventionally known a sheet feeding apparatus using an ultrasonic sensor. The ultrasonic sensor includes an ultrasonic generator and an ultrasonic receiver disposed opposite to each other with a sheet feeding path interposed therebetween. An amount of attenuation of an ultrasonic wave in the sheet is different between feeding of a single sheet between the ultrasonic generator and the ultrasonic receiver and feeding of a plurality of sheets therebetween. Thus, this sheet feeding apparatus compares the amount of the attenuation with a predetermined threshold value to judge whether the double feeding has occurred or not.

SUMMARY OF THE INVENTION

However, if the occurrence of the double feeding is judged based on a change of a physical quantity related to the fed sheet as in the above-described conventional technique, the apparatus may erroneously judge that the double feeding has occurred where a single thick sheet or a single carrier sheet comprised of a plurality of sheets joined together is fed.

This invention has been developed to provide a sheet feeding apparatus capable of preventing erroneous judgment of double feeding when compared with a configuration in which the occurrence of the double feeding is judged only based on a change of a physical quantity related to a sheet.

The present invention provides a sheet feeding apparatus, including: a sheet feeding mechanism configured to feed a sheet; a sheet sensor configured to detect, as a detection value, a physical quantity related to the sheet fed by the feeding mechanism; a physical-quantity judgment section configured to judge whether the detection value detected by the sheet sensor falls within a predetermined range; an another-sheet judgment section configured to judge whether there is another sheet after a sheet fed by the feeding mechanism and to be judged by the physical-quantity judgment section, said another sheet being a sheet different from the sheet fed by the feeding mechanism; and a double-feeding judgment section configured to judge that double feeding has occurred when the physical-quantity judgment section judges that the detection value does not fall within the predetermined range and when the another-sheet judgment section judges that there is another sheet, the double-feeding judgment section being configured to judge that the double feeding has not occurred when the physical-quantity judgment section judges that the detection value does not fall within the predetermined range and when the another-sheet judgment section judges that there is no another sheet.

The present invention also provides a sheet feeding apparatus, including: a sheet feeding mechanism configured to feed a sheet; a sheet sensor configured to detect, as a detection value, a physical quantity related to the sheet fed by the feeding mechanism; a physical-quantity judgment section configured to judge whether the detection value detected by the sheet sensor falls within a predetermined range; an another-sheet judgment section configured to judge whether there is another sheet after a sheet fed by the feeding mechanism and to be judged by the physical-quantity judgment section, said another sheet being a sheet different from the sheet fed by the feeding mechanism; and a notification portion configured to perform notification when the physical-quantity judgment section judges that the detection value does not fall within the predetermined range and when the another-sheet judgment section judges that there is another sheet.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which.

DETAILED DESCRIPTION OF THE EMBODIMENT

One Embodiment

Hereinafter, there will be described one embodiment of the present invention with reference to FIGS. 1-8. In the following explanation, a direction indicated by reference sign X in FIGS. 1 and 2 coincides with a frontward direction of an image reading apparatus 1, reference sign Y indicates a rightward direction, and reference sign Z indicates an upward direction. It is noted that the image reading apparatus 1 is one example of a sheet feeding apparatus.

1. Mechanical Structure of Image Reading Apparatus

Figure 1:
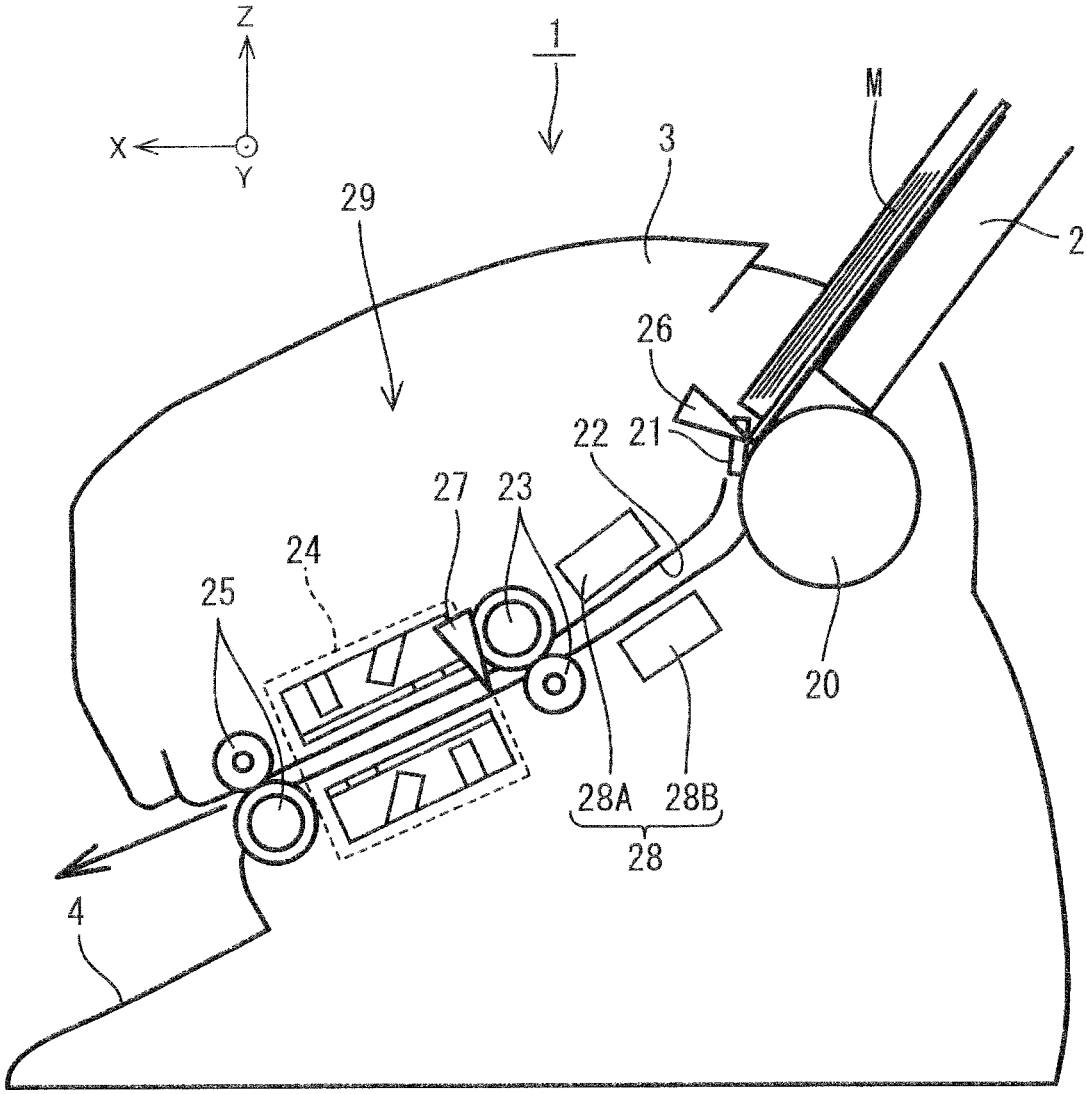
FIG. 1 is a schematic view showing an internal structure of an image reading apparatus 1 as one embodiment.

As shown in FIG. 1, the image reading apparatus 1 includes a document tray 2, a main body 3, and a discharge tray 4. This image reading apparatus 1 feeds or conveys a document M placed on the document tray 2 into the main body 3 and uses an image reading portion 24 provided in the main body 3 to read an image on the fed document M. The image reading apparatus 1 discharges onto the discharge tray 4 the document M whose image has been read. That is, the image reading apparatus 1 is in the form of a sheet feed scanner. It is noted that the document M is one example of a sheet, and the document M is not limited to a paper sheet and may be another type of sheet such as a plastic sheet.

The document tray 2 is provided on a rear portion of the main body 3 in a state in which the document tray 2 inclines downward in the frontward direction. One or more documents M are placed on this document tray 2. In the main body 3 is formed a feeding path 22 extending from a front end of the document tray 2 to a rear end of the discharge tray 4. Provided in or on the feeding path 22 are a pickup roller 20, a separator pad 21, feed rollers 23, the image reading portion 24, a discharge rollers 25, a front sensor 26, a rear sensor 27, and an ultrasonic sensor 28. The rear sensor 27 is one example of a sheet presence sensor, and the ultrasonic sensor 28 is one example of a sheet sensor.

The pickup roller 20 is disposed under the front end of the document tray 2 and rotatable to supply one or a plurality of the documents M placed on the document tray 2, into the main body 3 by a frictional force between the pickup roller 20 and the document M. The separator pad 21 is disposed opposite to the pickup roller 20 and separates the documents M from one another by a frictional force between the separator pad 21 and the document M. As a result, the documents M are fed into the main body 3 one by one.

The feed rollers 23 are provided on a downstream side of the pickup roller 20 and the separator pad 21 in the feeding path 22 in a document (sheet) feeding direction in which the document M is fed through the feeding path 22. The feed rollers 23 are driven by a motor, not shown, to feed the document M in the feeding path 22 frontward. The image reading portion 24 is provided on a downstream side of the feed rollers 23 in the document feeding direction and configured to read the image on the document M being fed by the feed rollers 23.

The discharge rollers 25 are provided on a downstream side of the image reading portion 24 in the feeding path 22 in the document feeding direction. The discharge rollers 25 are rotatable to discharge the document M for which an image reading operation has been performed by the image reading portion 24, to an outside of the main body 3. The discharge tray 4 is provided on a front portion of the main body 3. The documents M discharged to the outside of the main body 3 are stacked on the discharge tray 4. It is noted that the feeding path 22, the pickup roller 20, the feed rollers 23, and the discharge rollers 25 constitute a feeding mechanism 29.

The front sensor 26 is provided at a front end portion of the document tray 2. This front sensor 26 senses the presence or absence of the document M disposed on the document tray 2 and outputs a sense signal SG1 in response to a result of the sense operation. The rear sensor 27 senses the presence or absence of the document M in a middle of the feeding path 22 and outputs a sense signal SG2 in response to a result of the sense operation. It is noted that each of the front sensor 26 and the rear sensor 27 may be any of a contact sensor such as a pressure sensor and a non-contact sensor such as an optical sensor and a magnetic sensor, for example.

The ultrasonic sensor 28 includes an ultrasonic generator 28A and an ultrasonic receiver 28B disposed opposite to each other with the feeding path 22 interposed therebetween. This ultrasonic sensor 28 is configured to output a detection signal SG3 depending upon an amount of an ultrasonic wave received by the ultrasonic receiver 28B. The thicker the sheet fed through the feeding path 22, the less amount of the ultrasonic wave the ultrasonic receiver 28B receives. Therefore, it is possible to judge whether double feeding has occurred or not based on this amount of the ultrasonic wave received by the ultrasonic receiver 28B. It should be noted that, in the present embodiment, it is not judged that the double feeding has occurred only based on the detection signal SG3 outputted from the ultrasonic sensor 28 as will be described below.

2. Structure of Image Reading Portion

Figure 2:
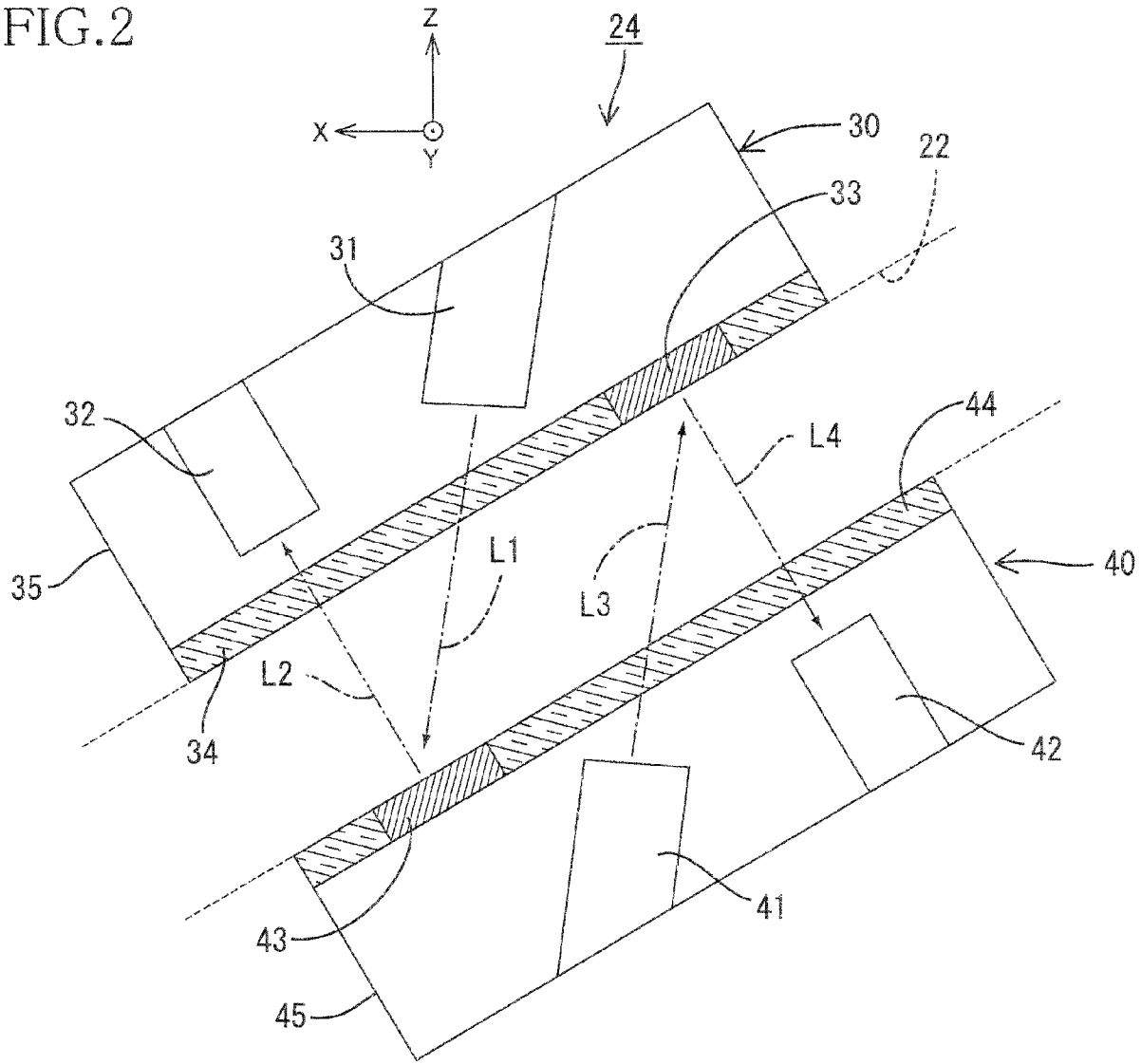
FIG. 2 is a schematic view showing a structure of an image reading portion 24.

As shown in FIG. 2, the image reading portion 24 includes a reading device 30 and a reading device 40 arranged opposite to each other with the feeding path 22 interposed therebetween. The reading devices 30, 40 are provided so as not to be moved relative to each other in the document feeding direction. An area between the reading devices 30, 40 is a reading area. It is noted that each of the reading devices 30, 40 is preferably a contact image sensor (CIS) or a charge coupled drive image sensor (CCD).

The reading device 30 is disposed on an upper side of the feeding path 22 and configured to read an image on one face of the document M being fed. In other words, the reading device 30 reads the image on an upper face of the document M being fed. Specifically, the reading device 30 has a structure in which a light source 31, a light receiving portion 32, a reference member 33, and a platen glass 34 are mounted on a carriage 35. The light source 31 includes a light emitting element such as a light-emitting diode. The light source 31 may have a structure including not only the light emitting element but also an optical system such as a projecting lens. The light receiving portion 32 includes a plurality of light receiving elements, not shown, arranged in a right and left direction. The platen glass 34 is disposed along the feeding path 22. The light source 31 emits a light L1 via the platen glass 34 to the document M fed through the feeding path 22 or the reference member 43 of the reading device 40. The light receiving portion 32 receives a light L2 reflected from the document M or the reference member 43.

The reading device 40 is disposed on a lower side of the feeding path 22 and configured to read an image on the other face of the document M being fed. In other words, the reading device 30 reads the image on a lower face of the document M being fed. Specifically, the reading device 40 has a structure in which a light source 41, a light receiving portion 42, a reference member 43, and a platen glass 44 are mounted on a carriage 45. Each of the light source 41 and the light receiving portion 42 has the same structure as that of a corresponding one of the light source 31 and the light receiving portion 42. The platen glass 44 is disposed along the feeding path 22. The light source 41 emits a light L3 via the platen glass 44 to the document M fed through the feeding path 22 or the reference member 33 of the reading device 30. The light receiving portion 42 receives a light L4 reflected from the document M or the reference member 33.

Not only a white reference plate but also a gray reference plate or any other similar plate may be used as each of the reference member 33 and the reference member 43. The reference member 33 and the reference member 43 are embedded respectively in the platen glasses 34, 44 in FIG. 2 but may be disposed on front or back faces of the respective platen glasses 34, 44. The reading device 30 uses the reference member 43 of the reading device 40 to obtain white reference data required for shading correction and the like. The reading device 40 uses the reference member 33 of the reading device 30 to obtain white reference data required for shading correction and the like.

Figure 3:
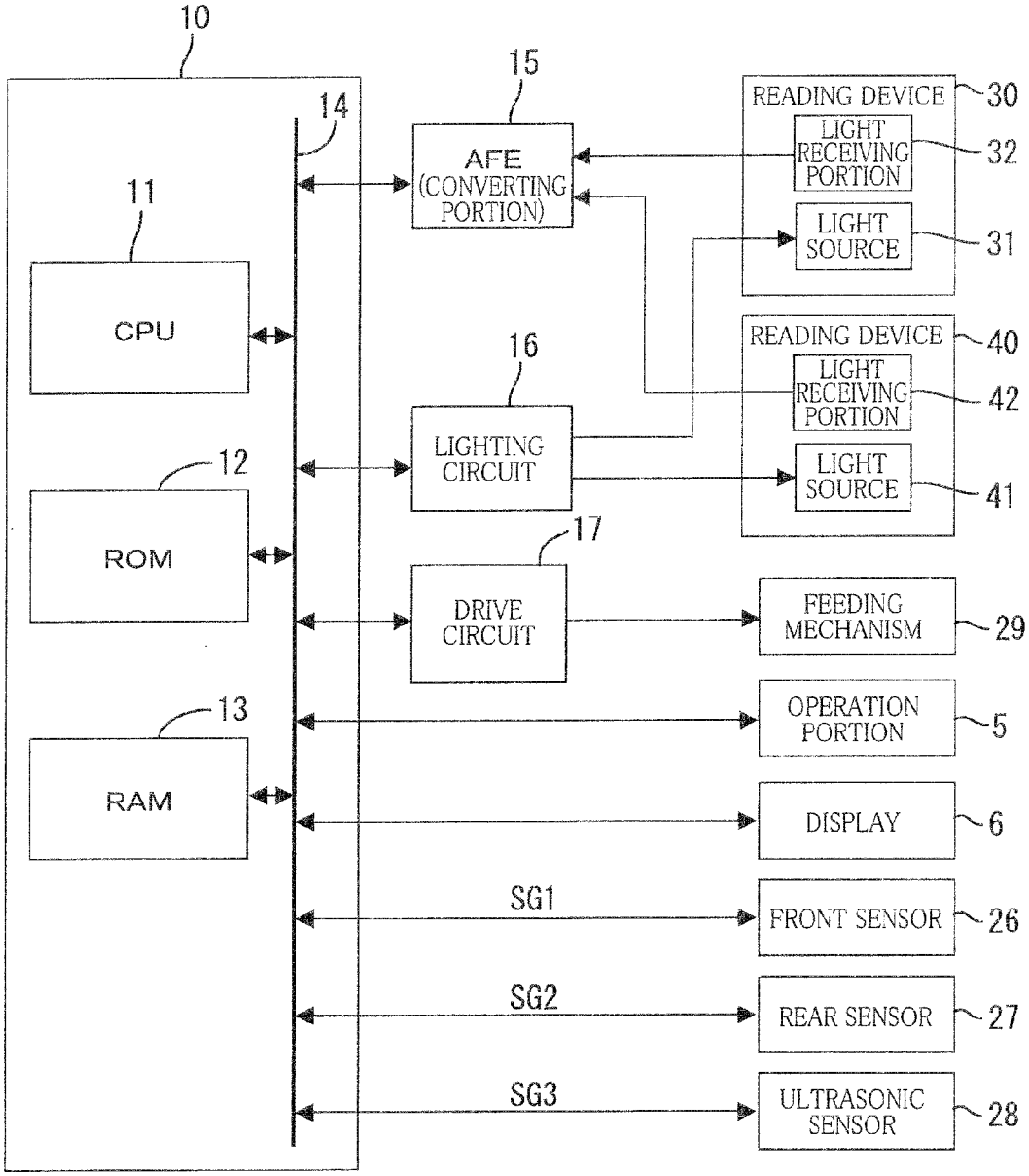
FIG. 3 is a block diagram schematically showing an electric configuration of the image reading apparatus 1.

The main body 3 includes an operation portion 5 and a display 6 (see FIG. 3). The operation portion 5 includes a power switch and various setting buttons and receives or accepts various operational instructions from a user. The display 6 is a liquid crystal display configured to display a state of the image reading apparatus 1 and the image on the document read by the image reading portion 24.

3. Electric Configuration of Image Reading Apparatus

As shown in FIG. 3, the image reading apparatus 1 includes a control circuit 10 configured to control the components of the image reading apparatus 1. The control circuit 10 includes a central processing unit (CPU) 11, a ROM 12, and a RAM 13. Connected to the CPU 11, the ROM 12, and the RAM 13 via a bus 14 are the operation portion 5, the display 6, an analog front end (AFE) 15, a lighting circuit 16, a drive circuit 17 for driving the rollers of the feeding mechanism 29, the reading devices 30, 40, the front sensor 26, the rear sensor 27, the ultrasonic sensor 28, and so on.

The ROM 12 stores therein various programs such as a control program for controlling the operations of the image reading apparatus 1. The CPU 11 controls the components of the image reading apparatus 1 according to the control program read from the ROM 12. Other than the ROM 12, a medium for storing the control program is preferably a non-volatile (non-transitory) memory such as a CD-ROM, a hard disc device, and a flash Memory™.

The lighting circuit 16 is connected to the reading devices 30, 40. Based on a command from the CPU 11, the lighting circuit 16 sends each of the reading devices 30, 40 a signal for controlling the light emission and a length of time for the emission (emission time) of each of the light sources 31, 41. When having received the signal from the lighting circuit 16, each of the reading devices 30, 40 has a corresponding one of the light sources 31, 41 emit the light over the emission time. Upon this light emission, each of the reading devices 30, 40 receives, by the corresponding one of the light receiving portions 32, 42, the light reflected from the document M fed through the feeding path 22 based on the command from the CPU 11 or the corresponding one of the reference members 33, 43, and then sends the AFE 15 read voltages each as an analog signal responsive to an amount of the light received by the corresponding one of the light receiving portions 32, 42. Specifically, each of the reading devices 30, 40 receives the reflected light by using the light receiving elements of the corresponding light receiving portion 32 or 42 and then successively outputs, to the AFE 15, the read voltages each responsive to the amount of the light received by the light receiving elements.

The AFE 15 is connected to the reading devices 30, 40 and includes an A/D converter circuit for converting, to read data as digital signals, the read voltages outputted from the reading devices 30, 40 based on the command from the CPU 11. The AFE 15 has a predetermined resolving power B (e.g., tones between 0 and 255 if data obtained by the conversion of the AFE 15 is represented by eight bits). The AFE 15 performs the A/D conversion from the read voltages outputted from the reading devices 30, 40, to the read data represented by eight bits (0-255). The read data obtained by the conversion of the AFE 15 is stored into the RAM 13 via the bus 14.

4. Double-Feeding Judgment Processing

Figure 4:
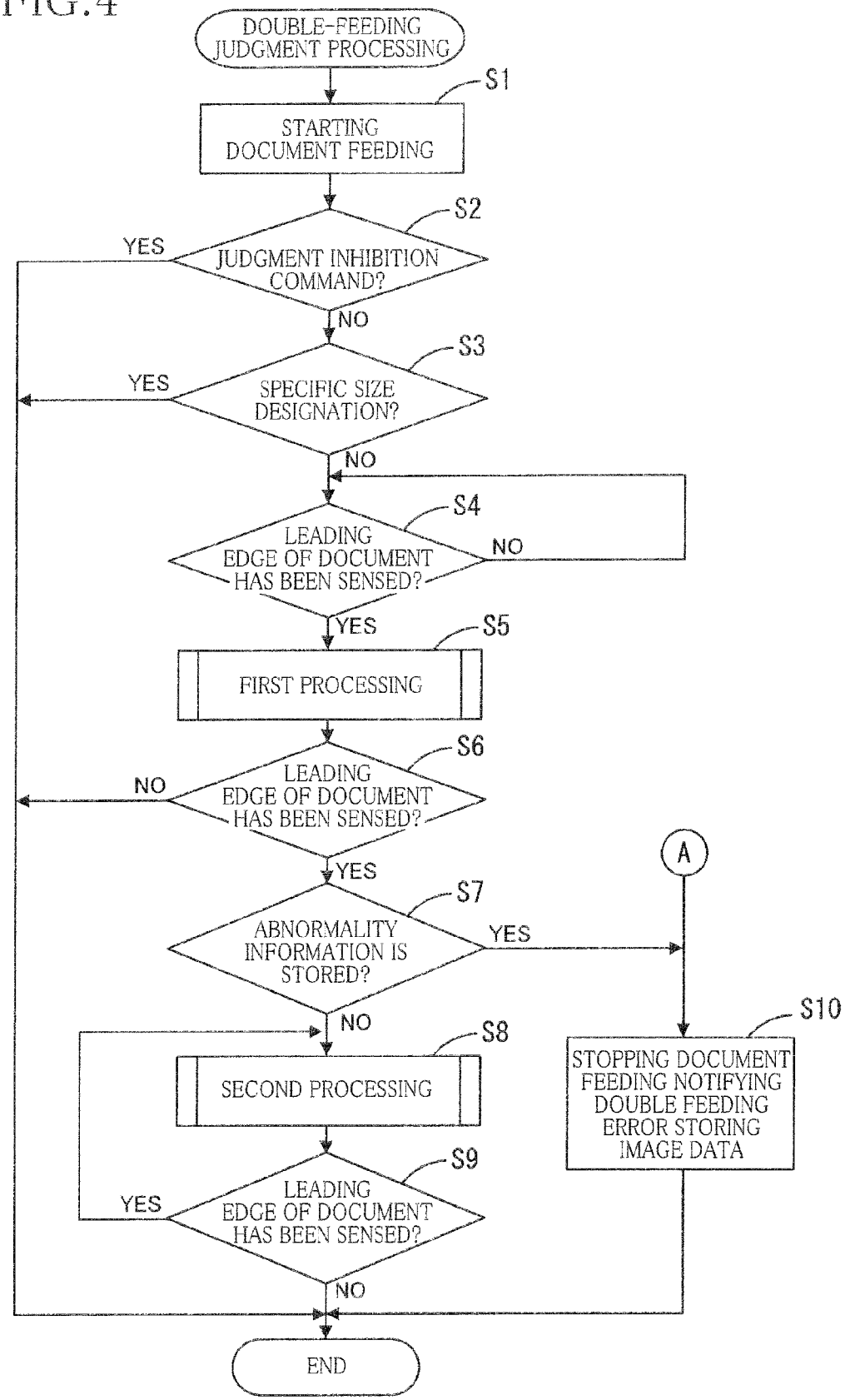
FIG. 4 is a flow-chart showing a double-feeding judgment processing.

FIG. 4 is a flow-chart representing a double-feeding judgment processing executed by the control circuit 10 (specifically, the CPU 11).

When the CPU 11 has accepted or received a command for starting the image reading which is outputted in response to the operation of the operation portion 5 by the user or reception of a command signal from an external device, and when the CPU 11 judges that the document(s) M are present on the document tray 2 based on the sense signal SG1 outputted from the front sensor 26, the CPU 11 executes the double-feeding judgment processing shown in FIG. 4 according to the above-described control program. In S1, the CPU 11 starts to drive the feeding mechanism 29 via the drive circuit 17. As a result, the document(s) M placed on the document tray 2 is or are fed through the feeding path 22.

Then in S2, the CPU 11 judges whether the CPU 11 has received a judgment inhibition command for inhibiting the CPU 11 from judging whether the double feeding has occurred or not. It is noted that the judgment inhibition command is accepted or received in response to the operation of the operation portion 5 by the user or based on the command signal from the external device, for example. In this operation, the CPU 11 is one example of a command acceptance section.

When the CPU 11 has accepted the judgment inhibition command (S2: YES), the CPU 11 finishes this double-feeding judgment processing but continues the feeding and an image reading processing for the document(s) M placed on the document tray 2. Thus, when the user wants to perform the image reading processing for a plurality of the documents M each of whose feeding is liable to be misjudged as the double feeding such as carrier sheets and cards, the user can input the judgment inhibition command, for example, to inhibit the judgment whether the double feeding has occurred and to continue the feeding and the image reading processing for the documents M.

When the CPU 11 has not accepted the judgment inhibition command (S2: NO), the CPU 11 in S3 judges whether a specific size has been designated as a size of the document M to be read. For example, the specific size is preferably a typical size of the documents (such as a size of a credit card) each greater in thickness than a plain paper sheet and thus whose feeding is liable to be misjudged as the double feeding. This size designation is accepted in response to the operation of the operation portion 5 by the user or based on the command signal from the external device, for example. In this operation, the CPU 11 is one example of a size acceptance section. It is noted that, where the image reading apparatus 1 includes a size detection sensor, not shown, disposed on the document tray 2 for detecting the size of the document M, the CPU 11 may accept the size designation based on a detection result of the size detection sensor.

When the CPU 11 judges that the CPU 11 has accepted the size designation of the specific size (S3: YES), the CPU 11 finishes this double-feeding judgment processing but continues the feeding and the image reading processing for the document(s) M placed on the document tray 2. Thus, when the user wants to perform the image reading processing for a plurality of the documents M each of whose feeding is liable to be misjudged as the double feeding such as the cards, the user can input the size designation, for example, to inhibit the judgment whether the double feeding has occurred and to continue the feeding and the image reading processing for the documents M. When the CPU 11 judges that the CPU 11 has not accepted the size designation of the specific size (S3: NO), the CPU 11 in S4 judges whether a leading (front) edge of the document M is present or not based on a sense result indicated by the sense signal SG2 outputted from the rear sensor 27. When the CPU 11 judges that the result of the sense operation of the sense signal SG2 indicates the absence of the document M (S4: NO), the CPU 11 judges that the leading edge of the document M has not been sensed, and repeats the processing in S4. When the indication of the result of the sense operation of the sense signal SG2 has been changed from the absence of the document M to the presence of the document M, the CPU 11 judges that the leading edge of the document M has been sensed (S4: YES). When the leading edge of the document M has been sensed, the CPU 11 controls the image reading portion 24 to perform the image reading operation for the document M whose leading edge has been sensed, and then executes a first processing in S5.

(1) First Processing

Figure 5:
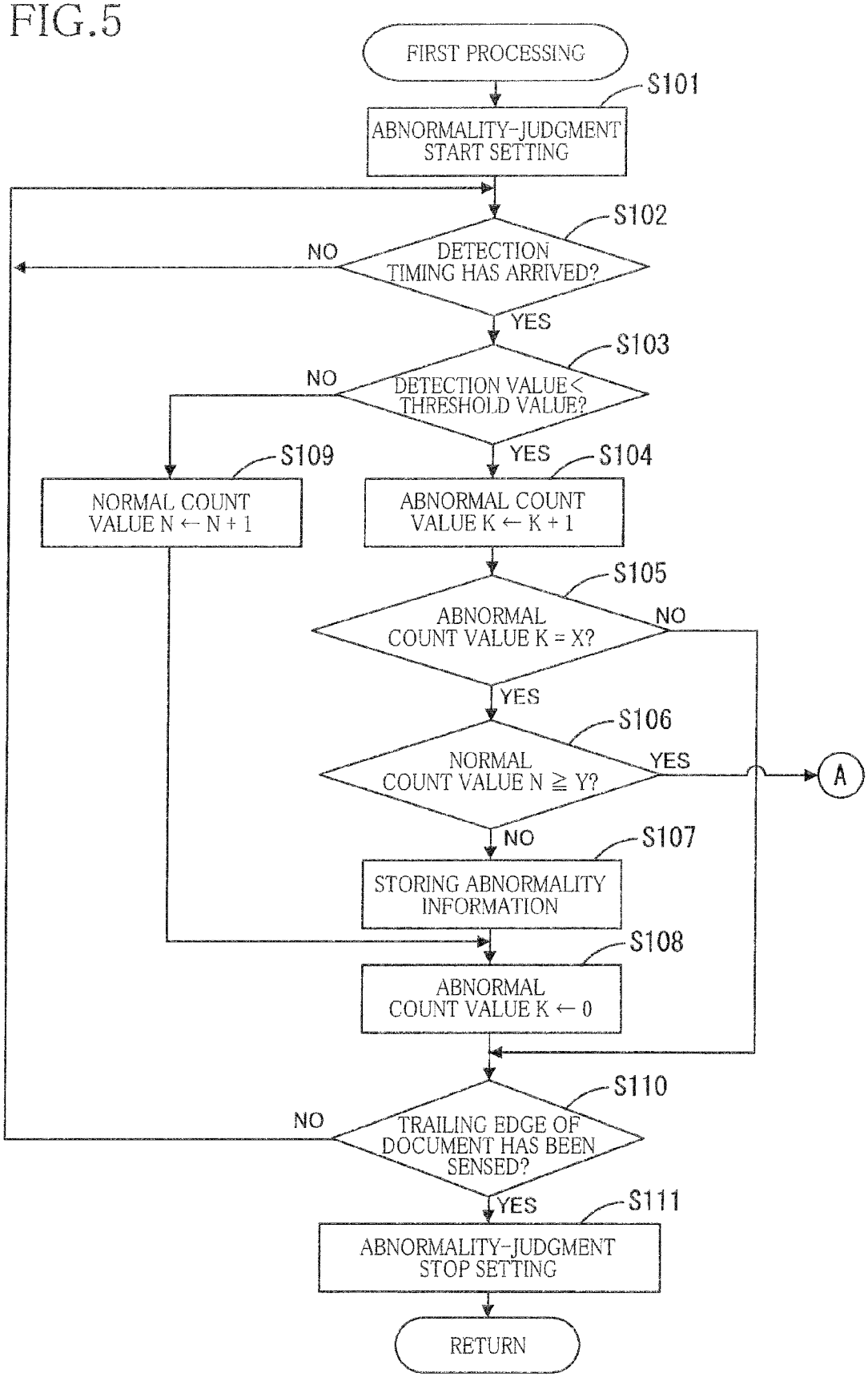
FIG. 5 is a flow-chart showing a first processing.

There will be explained the first processing with reference to FIG. 5. This first processing is initiated with S101 in which the CPU 11 executes an abnormality judgment start setting. Specifically, the CPU 11 initializes each of an abnormal count value and a normal count value stored in the RAM 13 to zero and activates the ultrasonic sensor 28, for example. The CPU 11 controls an internal timer to count a time, for example, and in S102 judges whether one of detection timings appearing at predetermined time intervals has arrived. When the CPU 11 judges that the detection timing has not arrived (S102: NO), the CPU 11 repeats the processing in S102.

When the CPU 11 judges that the detection timing has arrived (S102: YES), the CPU 11 in S103 controls the AFE 15 to perform the A/D conversion of the detection signal SG3 outputted from the ultrasonic sensor 28 and judges whether a detection value of the converted data is less than a threshold value. In this operation, the CPU 11 serves as a physical-quantity judgment section. For example, the threshold value is preferably a value greater than the detection value of the ultrasonic sensor 28 when two overlapping standard-size sheets such as plain paper sheets are present between the ultrasonic generator 28A and the ultrasonic receiver 28B and less than the detection value of the ultrasonic sensor 28 when a single standard-size sheet is present between the ultrasonic generator 28A and the ultrasonic receiver 28B.

When the CPU 11 judges that the detection value is less than the threshold value (S103: YES), a single or a plurality of documents M greater in thickness than the single standard-size sheet may be present between the ultrasonic generator 28A and the ultrasonic receiver 28B. Thus, when the positive decision is made in S103, the CPU 11 judges that the document M is abnormal and in S104 adds one to the abnormal count value K. On the other hand, when the CPU 11 judges that the detection value is equal to or greater than the threshold value (S103: NO), a document M not greater in thickness than the single standard-size sheet may be present between the ultrasonic generator 28A and the ultrasonic receiver 28B. Thus, when the positive decision is made in S103, the CPU 11 judges that the document M is normal and in S109 adds one to the normal count value N. Then in S108, the CPU 11 initializes the abnormal count value K to zero.

In S105, the CPU 11 judges whether the abnormal count value K after the addition has reached an upper limit value X (e.g., four). When the CPU 11 judges that the abnormal count value K has reached the upper limit value X (S105: YES), the CPU 11 in S106 judges whether the normal count value N after the addition is equal to or greater than the upper limit value Y (e.g., twelve). When the CPU 11 judges that the normal count value N is less than the upper limit value Y (S106: NO), the CPU 11 in S107 stores the abnormality information into the RAM 13, for example, and goes to S108. That is, when the CPU 11 has judged that the document M is abnormal X times successively, the CPU 11 stores the abnormality information such as an abnormality flag. However, as will be described below, the CPU 11 does not judge that the double feeding has occurred, only based on the result of the judgment in S106.

Even when the CPU 11 judges that the abnormal count value K after the addition has reached the upper limit value X (S105: YES), when the CPU 11 judges that the normal count value N is equal to or greater than the upper limit value Y (S106: YES), the CPU 11 does not store the abnormality information. When the CPU 11 has judged that the document M is normal more than Y times and judged that the document M is abnormal X times successively during a period from the sense of the leading edge of the document M to the sense of a trailing (rear) edge of the document M, the CPU 11 judges that partly-overlapping double feeding has occurred. The partly-overlapping double feeding refers to a condition when a plurality of the documents M are fed together with their leading edges not aligned (specifically, edge portions of the documents M overlap one another).

Figure 6:
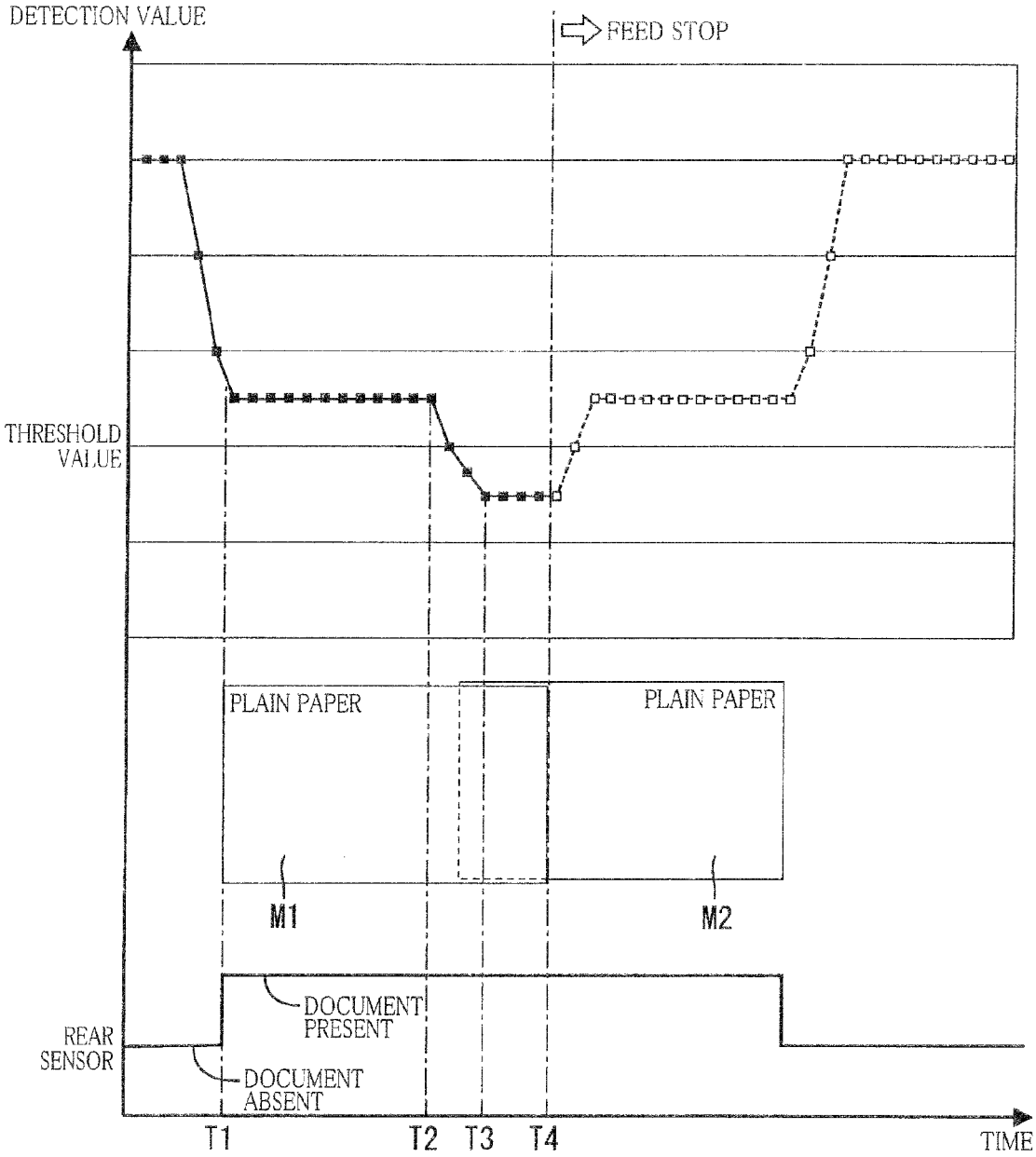
FIG. 6 is a schematic view showing a relationship between a sheet feeding state and a change of a detection value upon partly-overlapping double feeding.

FIG. 6 is a schematic view showing a relationship between a change of the detection value and a state of the fed sheet (hereinafter referred to as "sheet feeding state" where appropriate) at the position of the rear sensor 27 in the feeding path 22 upon the partly-overlapping double feeding. In FIG. 6, the documents M1, M2 are fed in a state in which a trailing end portion of the first or the preceding document M1 and a leading end portion of the second or the following document M2 overlap each other. Each of the documents M1, M2 is a plain paper sheet. In this case, after the leading edge of the document M1 is sensed by the rear sensor 27 (S2: YES), the CPU 11 judges that the document M is normal more than Y times between time T1 and time T2 (S106: YES) and then judges that the document M is abnormal X times successively between time T3 and time T4 (S105: YES).

At this time, the trailing edge of the document M2 has not sensed by the rear sensor 27. Where the document M is the carrier sheet, the card, or the like, since the document M has a generally the same thickness in its whole length in a front and rear direction, the CPU 11 seldom judges that the document M is abnormal X times successively and judges that the document M is normal more than Y times during the sense of the presence of the document M by the rear sensor 27. Thus, when the CPU 11 has judged that the document M is abnormal X times successively and judged that the document M is normal more than Y times during the sense of the presence of the document M by the rear sensor 27, the CPU 11 judges that the partly-overlapping double feeding has occurred.

When the CPU 11 judges that the partly-overlapping double feeding has occurred (S106: YES), the CPU 11 in S10 stops the document feeding and executes a processing for a notification operation of a double feeding error. It is noted that examples of the notification operation include: displaying a message indicating the double feeding error on the display 6; outputting a voice from a sound producing device, not shown; and outputting a notification signal to the external device communicably connected to the image reading apparatus 1. As a result, the CPU 11 can notify the user of the occurrence of the double feeding. In this operation, the display 6 or the like are one example of a notification portion.

Further, the CPU 11 in S10 stores image data read until this time by the image reading portion 24, into the RAM 13, for example. Here, where image data representative of a plurality of the documents M are combined into one file (e.g., one PDF file), for example, when the CPU 11 has judged that the double feeding or the partly-overlapping double feeding has occurred, the CPU 11 may discard image data based on an already-read part of the documents M together with other unnecessary data. In order to avoid this, the CPU 11 stores (does not discard) the image data read until this time by the image reading portion 24 into the RAM 13, for example. In this operation, the CPU 11 and the RAM 13 are one example of an image storage portion.

When the CPU 11 judges that the abnormal count value K has not reached the upper limit value X (S105: NO) or when the CPU 11 in S108 initializes the abnormal count value K to zero, the CPU 11 in S110 judges whether the trailing edge of the document M has been sensed, based on the sense signal SG2 outputted from the rear sensor 27. When the CPU 11 judges that the trailing edge of the document M has not been sensed (S110: NO), the CPU 11 returns to S102. When the CPU 11 judges that the trailing edge of the document M has been sensed (S110: YES), the CPU 11 in S111 executes an abnormality judgment stop setting and then finishes this first processing. The CPU 11 then goes to S6 in FIG. 4. In the abnormality judgment stop setting, the CPU 11 turns off the ultrasonic sensor 28, for example.

(2) Judgment of Double Feeding

In S6, the CPU 11 judges whether the leading edge of the document M has been sensed, based on the sense signal SG1 outputted from the rear sensor 27. That is, the CPU 11 uses the rear sensor 27 to judge whether there is another document M to be read after one or a plurality of documents M for which the CPU 11 has judged whether the document M is abnormal or not in the first processing. The rear sensor 27 and the CPU 11 are one example of an another-sheet judgment section.

When the CPU 11 judges that the leading edge of the document M as said another document has not been sensed even when a predetermined length of time has passed from the sense of the trailing edge of the document M by the rear sensor 27 (S6: NO), the CPU 11 judges that there is no another document M and finishes this double-feeding judgment processing even when the CPU 11 has judged that the preceding document M is abnormal in the first processing. On the other hand, when the CPU 11 judges that the leading edge of the document M has been sensed in the predetermined length of time (S6: YES), the CPU 11 in S7 judges whether the abnormality information is stored in the RAM 13. When the CPU 11 judges that the abnormality information is stored (S7: YES), the CPU 11 judges that the double feeding has occurred and goes to S10. In view of the above, the CPU 11 is one example of a double-feeding judgment section. Further, another sheet is a document to be fed in a reading job in which one or more documents M are fed for which the judgment whether the document(s) M are abnormal or not is performed in the first processing.

Figure 7:
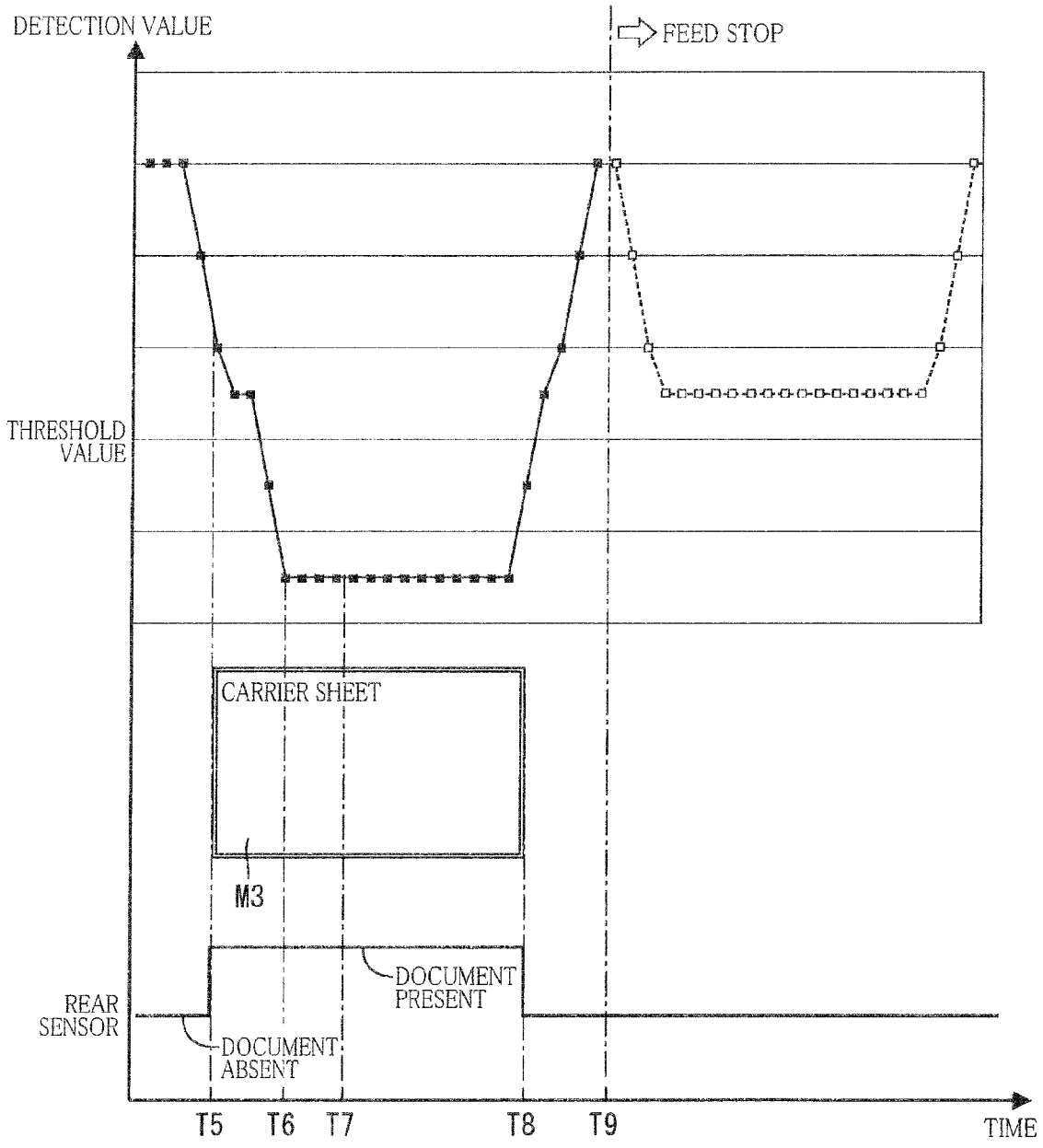
FIG. 7 is a schematic view showing a relationship between a sheet feeding state and a change of a detection value upon double feeding.

FIG. 7 is a schematic view showing a relationship between the sheet feeding state and the change of the detection value upon the double feeding. In FIG. 7, a first document M3 in the form of the carrier sheet is being fed. In this case, after a leading edge of the document M3 is sensed by the rear sensor 27 at time T5 (S2: YES), the CPU 11 judges that the document M is abnormal X times successively between time T6 and time T7 (S105: YES). However, at this point in time, the CPU 11 merely stores the abnormality information (S107) and does not judge that the double feeding has occurred.

After the trailing edge of the document M3 has been sensed by the rear sensor 27 at time T8 (S110: YES), when the CPU 11 judges that the leading edge of the next document M has not been sensed by the rear sensor 27 by time T9 that is after a predetermined length of time from time T8 (S6: NO), the CPU 11 judges that the double feeding has not occurred at this time. Where the document M is the carrier sheet, a single carrier sheet is generally used for the feeding and the image reading without multiple feedings. Thus, even when the CPU 11 has judged that the document M is abnormal X times successively, when there is no another document M, the CPU 11 judges that the document M3 is a sheet not to be judged that the double feeding has occurred such as the carrier sheet and judges that the double feeding has not occurred. It is noted that, in the example in FIG. 7, the CPU 11 never judges that the document M is normal more than Y times before judging that the document M is abnormal X times successively.

When the CPU 11 judges that the leading edge of the document M has been sensed in the predetermined length of time (S6: YES) and when the abnormality information is not stored in the RAM 13 (S7: NO), the CPU 11 judges that the double feeding has not occurred and goes to S8 for executing a second processing. For example, in the example in FIG. 7, if the document M3 is a plain paper sheet, and the next document M in the form of the plain paper sheet is fed, the CPU 11 judges that the double feeding has not occurred and continues the feeding and the image reading processing for the document M.

(3) Second Processing

Figure 8:
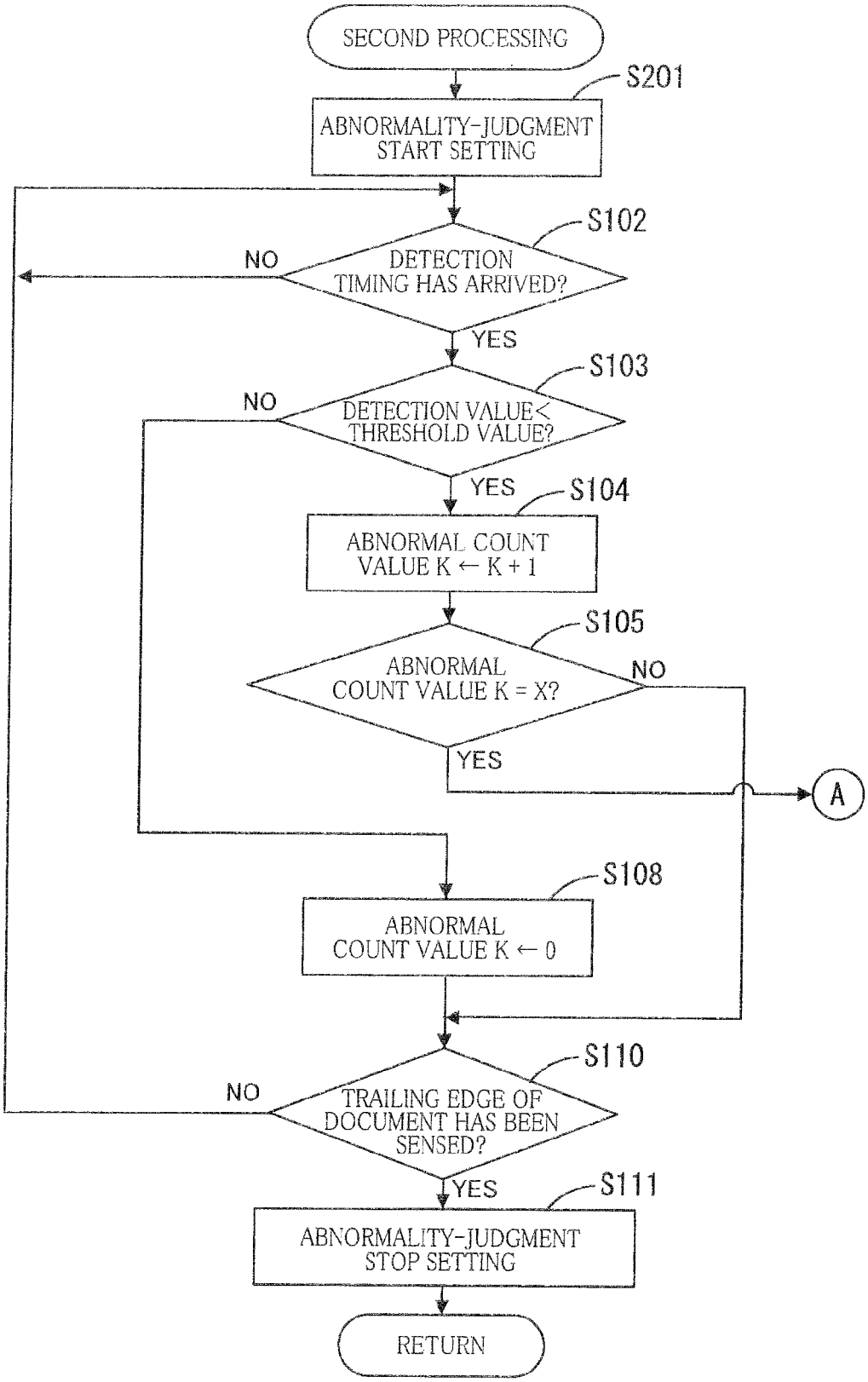
FIG. 8 is a flow-chart showing a second processing.

There will be explained the second processing with reference to FIG. 8. It is noted that the same steps as used in the first processing in FIG. 5 are used to designate the corresponding processings of this second embodiment in FIG. 8, and an explanation of which is dispensed with, and only a difference of the second processing from the first processing will be explained. In the abnormality judgment start setting, the CPU 11 initializes the abnormal count value stored in, e.g., the RAM 13 to zero, activates the ultrasonic sensor 28, and deletes the abnormality information if the abnormality information is stored in the RAM 13. That is, the normal count value is not used in this second processing.

As described above, the second processing is executed for another document M that is fed just after the document M judged in the first processing. Thus, where the second processing is executed, it is highly probable that the document M is the plain paper sheet and less probable that the document M is a sheet greater in thickness than the plain paper sheet such as the carrier sheet. Accordingly, in the second processing, when the abnormal count value K has reached the upper limit value X, the CPU 11 judges that the double feeding has occurred and goes to S10 in FIG. 4. When the CPU 11 judges that the leading edge of the next document M has been sensed by the rear sensor 27 in the predetermined length of time (S9: YES), the CPU 11 repeats the second processing (S8). When the CPU 11 judges that the leading edge of the next document M has not been sensed by the rear sensor 27 in the predetermined length of time (S9: NO), the CPU 11 finishes this double-feeding judgment processing.

5. Effects of Present Embodiment

In general, where a relatively thick document M or a document comprised of a plurality of sheets joined together is fed, the document is often fed without successive feedings of a plurality of documents. Thus, in the present embodiment, when the detection value related to the thickness of the document fed by the feeding mechanism 29 does not fall within the predetermined range, the CPU 11 does not judge that the double feeding has occurred only based on this condition. The CPU 11 judges that the double feeding has occurred only when there is another document M fed following the preceding document M in addition to that condition. Accordingly, it is possible to prevent the CPU 11 from erroneously judging that the double feeding has occurred, when compared to a configuration in which the CPU judges the occurrence of the double feeding only based on the change of a physical quantity related to the thickness of the document.

The CPU 11 judges whether there is another document M fed after one or a plurality of documents M, based on the presence or absence of the sense (by the rear sensor 27) of the document M actually fed by the feeding mechanism 29. This improves an accuracy of the judgment of the presence or absence of another document M to be fed following the preceding document M, when compared to a configuration in which the CPU judges the presence or absence of another document M based on the presence or absence of the document M placed on the document tray 2.

The rear sensor 27 senses the presence or absence of the document M on a downstream side of the detection area of the ultrasonic sensor 28 in the document feeding direction. This can prevent an occurrence of a situation in which the CPU judges that the detection value of the ultrasonic sensor 28 falls within the predetermined range at a leading edge portion of one document M, and the CPU erroneously judges a trailing edge portion of the one document M as another document M before the one document M passes through the detection area of the ultrasonic sensor 28.

When the rear sensor 27 senses the presence of the document M in the middle of the feeding path 22, the CPU 11 judges whether the detection value of the ultrasonic sensor 28 falls within the predetermined range. This makes it possible to prevent the misjudgment of the occurrence of the double feeding by the detection value of the ultrasonic sensor 28 when the rear sensor 27 is not sensing the presence of the document M in the middle of the feeding path 22.

Where the image reading is performed by feeding a plurality of documents M continuously or intermittently by a single read command, when the CPU 11 has judged that the document M is abnormal for a second or subsequent document M in the second processing, the CPU 11 judges that the double feeding has occurred regardless of the presence or absence of another document M after the document M judged to be abnormal. Thus, the CPU 11 can judge that the double feeding has occurred for the second or subsequent document M at an earlier timing when compared to a first document. Further, when the CPU 11 judges that the double feeding has occurred, the feeding mechanism 29 is stopped, making it possible to prevent the document M from being continued to be fed in the state of the double feeding.

Since the ultrasonic sensor 28 for detecting the thickness of the document M is used, even in the case of the double feeding in which the documents of the same size entirely overlap with one another, the CPU 11 can judge that the document(s) M are abnormal. Further, since the CPU 11 judges that the double feeding has occurred when the rear sensor 27 is sensing the presence of the document M, the CPU 11 can distinguish the double feeding in which the documents entirely overlap with one another and the feeding of a single relatively thick document such as the carrier sheet from each other.

<Modifications>

It is to be understood that the invention is not limited to the details of the illustrated embodiment, but may be embodied with various changes and modifications, which may occur to those skilled in the art, without departing from the spirit and scope of the invention. For example, the following modifications can be made.

In the above-described embodiment, the image reading apparatus 1 is one example of the sheet feeding apparatus. However, the sheet feeding apparatus may be a recording apparatus, a facsimile machine, a copying machine, a multifunction device having various functions such as a scanning function and a copying function, or the like. Further, the sheet feeding apparatus may be a paper-money feeding device for feeding paper money or the like. That is, the sheet feeding apparatus may be any device as long as the device includes a feeding mechanism for feeding a sheet. It is noted that examples of the sheet include the paper sheet, the carrier sheet, a driver's license, and cards such as the credit card.

In the above-described embodiment, the ultrasonic sensor 28 is one example of the sheet sensor. However, the sheet sensor may be a weight sensor for detecting a weight of the sheet, an optical sensor for detecting a light transmittance of the sheet, a length sensor for detecting a length of a passed portion of the sheet based on a detection time of the presence of the sheet, or the like. It is noted that each of the ultrasonic wave, the weight, and the detected length is one example of the physical quantity related to the sheet.

In the above-described embodiment, the configuration using the rear sensor 27 is one example of the another-sheet judgment section. However, the another-sheet judgment section may use the front sensor 26. In this configuration, the another-sheet judgment section may be configured to judge that there is another sheet, when the front sensor 26 has sensed the presence of the document M on the document tray 2. Further, where the sheet feeding apparatus is the recording apparatus or the facsimile machine in particular, the apparatus may be configured to judge the presence of another sheet based on the number of the sheets to be recorded in one job and the number of the sheets having been recorded in the one job. Further, where the sheet feeding apparatus includes a manual tray on which the user manually sets the sheets, the apparatus may judge that there is no another sheet when the sheet on the manual tray is fed.

In the above-described embodiment, the rear sensor 27 is configured to sense the presence or absence of another document M at the position located on a downstream side of the detection area of the ultrasonic sensor 28 in the document feeding direction. However, instead of the rear sensor 27, the image reading apparatus 1 may use a sensor configured to sense the presence or absence of another document M at a position located on an upstream side of the detection area of the ultrasonic sensor 28 in the document feeding direction, like the front sensor 26. In this modification, the presence or absence of another document can be sensed earlier than in the above-described embodiment, making it possible to judge whether the double feeding has occurred, at an earlier timing.

In the above-described embodiment, the configuration in which the sheet is fed straight is one example of the feeding mechanism. However, the feeding mechanism may have a configuration in which the sheet is fed so as to be turned along a U-shape path or an S-shape path.

In the above-described embodiment, when the CPU 11 has accepted the judgment inhibition command or the size designation of the specific size (S3: NO, S4: YES), the CPU 11 finishes the double-feeding judgment processing to inhibit the judgment whether the double feeding has occurred. However, in this case, the CPU 11 may execute, e.g., the judgment whether the document M is abnormal but inhibit the judgment whether the double feeding has occurred, regardless of a result of the judgment whether the document M is abnormal.

In the above-described embodiment, the double-feeding judgment processing is finished depending upon the presence or absence of the judgment inhibition command and the presence or absence of the size designation of the specific size. However, the CPU 11 may omit at least one of the judgment of the presence or absence of the judgment inhibition command (S3) and the judgment of the presence or absence of the size designation of the specific size (S4) in the above-described double-feeding judgment processing.

In the above-described embodiment, when the CPU 11 has judged that the document M is abnormal X times successively, the CPU 11 stores the abnormality information. This configuration can prevent an erroneous judgment due to exceptions. However, the CPU 11 may store the abnormality information when the CPU 11 judges that the document M is abnormal once. Further, this image reading apparatus 1 may measure a length of time for which the CPU 11 continuously judges that the document M is abnormal, and the CPU 11 may store the abnormality information when the measured time reaches a reference time.

In the above-described embodiment, when the CPU 11 judges that the document M is normal more than Y times, the CPU 11 judges that the partly-overlapping double feeding has occurred. However, the CPU 11 may judge that the partly-overlapping double feeding has occurred, when the CPU 11 judges that the document M is normal once. Further, the CPU 11 may judge that the partly-overlapping double feeding has occurred, when the CPU 11 judges that the document M is normal a predetermined number of times successively. Further, this image reading apparatus 1 is configured such that the apparatus 1 measures a length of time for which the CPU 11 continuously judges that the document M is normal, and the CPU 11 judges that the partly-overlapping double feeding has occurred when the measured time reaches a reference time. It is noted that the reference time is preferably set at a length of time for which a portion of the document M corresponding to a predetermined length in the document feeding direction (e.g., more than one-third or one-half of the document M from its leading edge) passes through the sense area of the rear sensor 27.

In the above-described embodiment, one job includes the image reading of one or more documents M fed by one read command. However, in the case of the recording apparatus, for example, one job includes recording on one or more sheets fed by one recording command. Further, the CPU 11 judges one job by judging that image readings of two documents belong to the same job when a time interval between a sense of one document M by the rear sensor 27 and a sense of a next document M by the rear sensor 27 is within a predetermined reference time and by judging that the image readings of the two documents belong to different jobs when a time interval between a sense of a trailing edge of a last document by the rear sensor 27 in the preceding job and a sense of a leading edge of a first document by the rear sensor 27 in a job following the preceding job exceeds the predetermined reference time. Further, the CPU 11 judges one job by judging that image readings of two documents belong to the same job when a time interval between a sense of a trailing edge of one document M by the rear sensor 27 and a sense of a leading edge of a next document M by the front sensor 26 is within a predetermined reference time and by judging that the image readings of the two documents belong to different jobs when the time interval exceeds the predetermined reference time.

In the first processing in the above-described embodiment, the CPU 11 may not judge whether the partly-overlapping double feeding has occurred except in the processings relating the normal count value (S109, S106).

In the above-described embodiment, the control circuit 10 includes the single CPU 11, and the single CPU 11 executes the double-feeding judgment processing and the image reading processing. However, a plurality of the CPUs 11 may be used to execute the above-described control processings. For example, different CPUs may execute ones or all of the processings for judging the presence of another document, the double-feeding judgment processing, and the image reading processing. Further, the control circuit 10 is not limited to be comprised of a general-purpose CPU but may be comprised of a circuit for a particular use such as an application specific integrated circuit (ASIC) and a field-programmable gate array (FPGA).

In S103 in the above-described embodiment, the CPU 11 in S103 controls the AFE 15 to perform the A/D conversion of the detection signal SG3 outputted from the ultrasonic sensor 28 and judges whether the detection value of the converted data is less than the threshold value. Instead of this processing, the CPU 11 may be configured such that the CPU 11 includes a specific-quantity-sheet acceptance section configured to accept a user's designation of a sheet having a specific thickness (e.g., the credit card and the carrier sheet), and when the specific-quantity-sheet acceptance section has accepted the designation of the sheet having the specific thickness, the CPU 11 judges that the double feeding has not occurred (the notification operation is not to be performed).

What is claimed is:

1. A sheet feeding apparatus, comprising:

a sheet feeding mechanism configured to feed a sheet;

a sheet sensor configured to detect, as a detection value, a physical quantity related to the sheet fed by the feeding mechanism;

a physical-quantity judgment section configured to judge whether the detection value detected by the sheet sensor falls within a predetermined range;

an another-sheet judgment section configured to judge whether there is another sheet after a sheet fed by the feeding mechanism and to be judged by the physical-quantity judgment section, said another sheet being a sheet different from the sheet fed by the feeding mechanism;

a double-feeding judgment section configured to judge that double feeding has occurred when the physical-quantity judgment section judges that the detection value does not fall within the predetermined range and when the another-sheet judgment section judges that there is another sheet, the double-feeding judgment section being configured to judge that the double feeding has not occurred when the physical-quantity judgment section judges that the detection value does not fall within the predetermined range and when the another-sheet judgment section judges that there is no another sheet; and a command acceptance section configured to accept a judgment inhibition command for inhibiting the double-feeding judgment section from judging whether the double feeding has occurred, wherein, when the command acceptance section has accepted the judgment inhibition command, the double-feeding judgment section does not execute the judgment whether the double feeding has occurred, regardless of the judgments of the physical-quantity judgment section and the another-sheet judgment section.

2. The sheet feeding apparatus according to claim 1, wherein the another-sheet judgment section includes a sheet presence sensor configured to sense at least one of a presence and an absence of the sheet fed by the feeding mechanism, and wherein the another-sheet judgment section is configured to judge that there is another sheet, when the sheet presence sensor senses the presence of the sheet again after the sheet presence sensor ceases to sense a presence of one or a plurality of the sheets for which the physical-quantity judgment section has judged that the detection value does not fall within the predetermined range.

3. The sheet feeding apparatus according to claim 2, wherein the sheet presence sensor is disposed in a feeding path through which the sheet is fed, at a position located on a downstream side of a detection area of the sheet sensor in a sheet feeding direction.

4. The sheet feeding apparatus according to claim 3, wherein the another-sheet judgment section is configured to judge that there is another sheet, when the sheet presence sensor senses the presence of the sheet in a predetermined period after the sheet presence sensor ceases to sense a presence of one or a plurality of the sheets for which the physical-quantity judgment section has judged that the detection value does not fall within the predetermined range.

5. The sheet feeding apparatus according to claim 2, wherein the physical-quantity judgment section is configured to judge whether the detection value detected by the sheet sensor falls within the predetermined range when the sheet presence sensor is sensing the presence of the sheet.

6. The sheet feeding apparatus according to claim 2, wherein the double-feeding judgment section is configured to judge that the double feeding has occurred regardless of the judgment of the another-sheet judgment section, when the state in which the physical-quantity judgment section has judged that the detection value detected by the sheet sensor falls within the predetermined range and the state in which the physical-quantity judgment section has judged that the detection value detected by the sheet sensor does not fall within the predetermined range are present in a period in which the sheet presence sensor continuously senses the presence of the sheet.

7. The sheet feeding apparatus according to claim 2, wherein the sheet presence sensor is configured to sense at least one of the presence and the absence of the sheet at a position located on an upstream side of a detection area of the sheet sensor in a sheet feeding direction in which the sheet is fed.

8. The sheet feeding apparatus according to claim 1, wherein the sheet sensor is an ultrasonic sensor.

9. The sheet feeding apparatus according to claim 1, wherein the sheet sensor is an optical sensor.

10. The sheet feeding apparatus according to claim 1, wherein the double-feeding judgment section is configured to judge that the double feeding has occurred, when the physical-quantity judgment section judges that the detection value does not fall within the predetermined range for a second or subsequent sheet in one job.

11. The sheet feeding apparatus according to claim 1, further comprising a notification portion configured to notify that the double-feeding judgment section has judged that the double feeding has occurred.

12. The sheet feeding apparatus according to claim 1, further comprising a feeding controlling section configured to stop the sheet feeding of the feeding mechanism when the double-feeding judgment section judges that the double feeding has occurred.

13. The sheet feeding apparatus according to claim 1, further comprising:

an image reading portion configured to read an image on the sheet fed by the feeding mechanism; and an image storage portion configured to store image data, the image data being data obtained by the reading of the image reading portion at least until the double-feeding judgment section judges that the double feeding has occurred.

14. A sheet feeding apparatus, comprising:

a sheet feeding mechanism configured to feed a sheet;

a sheet sensor configured to detect, as a detection value, a physical quantity related to the sheet fed by the feeding mechanism;

a physical-quantity judgment section configured to judge whether the detection value detected by the sheet sensor falls within a predetermined range;

an another-sheet judgment section configured to judge whether there is another sheet after a sheet fed by the feeding mechanism and to be judged by the physical-quantity judgment section, said another sheet being a sheet different from the sheet fed by the feeding mechanism;

a double-feeding judgment section configured to judge that double feeding has occurred when the physical-quantity judgment section judges that the detection value does not fall within the predetermined range and when the another-sheet judgment section judges that there is another sheet, the double-feeding judgment section being configured to judge that the double feeding has not occurred when the physical-quantity judgment section judges that the detection value does not fall within the predetermined range and when the another-sheet judgment section judges that there is no another sheet; and a size acceptance section configured to accept a designation of a size of the sheet to be fed by the feeding mechanism, wherein, when the size acceptance section has accepted a designation of a specific size, the double-feeding judgment section does not execute the judgment whether the double feeding has occurred, regardless of the judgments of the physical-quantity judgment section and the another-sheet judgment section.

15. A sheet feeding apparatus, comprising:

a sheet feeding mechanism configured to feed a sheet;

a sheet sensor configured to detect, as a detection value, a physical quantity related to the sheet fed by the feeding mechanism;

a physical-quantity judgment section configured to judge whether the detection value detected by the sheet sensor falls within a predetermined range;

an another-sheet judgment section configured to judge whether there is another sheet after a sheet fed by the feeding mechanism and to be judged by the physical-quantity judgment section, said another sheet being a sheet different from the sheet fed by the feeding mechanism;

a notification portion configured to perform notification when the physical-quantity judgment section judges that the detection value does not fall within the predetermined range and when the another-sheet judgment section judges that there is another sheet; and a size acceptance section configured to accept a designation of a size of the sheet to be fed by the feeding mechanism, wherein, when the size acceptance section has accepted a designation of a specific size, the notification portion does not perform the notification.

16. A sheet feeding apparatus, comprising:

a sheet feeding mechanism configured to feed a sheet;

a sheet sensor configured to detect, as a detection value, a physical quantity related to the sheet fed by the feeding mechanism;

a physical-quantity judgment section configured to judge whether the detection value detected by the sheet sensor falls within a predetermined range;

an another-sheet judgment section configured to judge whether there is another sheet after a sheet fed by the feeding mechanism and to be judged by the physical-quantity judgment section, said another sheet being a sheet different from the sheet fed by the feeding mechanism;

a notification portion configured to perform notification when the physical-quantity judgment section judges that the detection value does not fall within the predetermined range and when the another-sheet judgment section judges that there is another sheet; and a specific-quantity-sheet acceptance section configured to accept a designation of a sheet having a specific physical quantity, wherein, when the specific-quantity-sheet acceptance section has accepted the designation of the sheet having the specific physical quantity, the notification portion does not perform the notification.

17. The sheet feeding apparatus according to claim 16, wherein the notification portion does not perform the notification, when the physical-quantity judgment section judges that the detection value does not fall within the predetermined range and when the another-sheet judgment section judges that there is no another sheet.

* * * * *